US005913772A

United States Patent [19]

Clark

[11] Patent Number: 5,913,772

[45] Date of Patent: Jun. 22, 1999

[54] TENT HAMMOCK

[76] Inventor: Gary L. Clark, 4637 South 300 West, Salt Lake City, Utah 84107

[21] Appl. No.: 09/089,636

[22] Filed: Jun. 3, 1998

[51] Int. Cl.[6] ..... A45F 3/22

[52] U.S. Cl. ..... 5/121; 5/122; 5/128

[58] Field of Search ..... 5/120, 121, 122, 5/123, 128

[56] References Cited

U.S. PATENT DOCUMENTS

| | | | |
|---|---|---|---|
| 1,182,185 | 5/1916 | Lysons | 5/121 X |
| 2,375,792 | 5/1945 | Kearny | 5/121 |
| 4,071,917 | 2/1978 | Mojica | 5/128 X |
| 4,308,883 | 1/1982 | Malone | 5/121 |
| 4,320,542 | 2/1984 | Cohen | 5/121 |
| 5,072,465 | 12/1991 | Lyons, Jr. | 5/121 |

*Primary Examiner*—Michael F. Trettel
*Attorney, Agent, or Firm*—K. S. Cornaby

[57] ABSTRACT

A hammock which has a netted fabric covering and a tarp suspended above it, form a structure similar to a tent suspended above ground. The tarp, made of waterproof lightweight fabric, is attached to the netted fabric in the middle and hangs down on either side of the hammock. The tarp can also be pulled out by the corners to form a canopy over the hammock by means of ropes tied to a branch of a tree or other support. Pockets attached to the underside of the hammock are large enough to hold clothing and other gear. These pockets also provide insulation from the cold. The main support comes from a single rope for each end attached through a sleeve which gives extreme stability. Elastic straps connected to the ends of the tarp adjust for stress to the tarp and netting as weight is applied to the hammock. A section of webbing sewn to the top of the head end of the netting and to the underside of the tarp provide a drop space between the tarp and netting which allows for condensation run off. The webbing also compensates for uneven pull between the tarp and hammock bed. The head and foot are enclosed by a similar waterproof fabric as the tarp and are attached to the netting to complete the enclosure. One enters from either side of the tent hammock through zippers in the netting. The tarp is also sewn down the sides at the foot end to create a completely waterproof barrier at that end.

2 Claims, 4 Drawing Sheets

TENT HAMMOCK

BACKGROUND OF INVENTION

This application relates to a combination tent and hammock.

Most hammock designs are too heavy to carry back packing and are usually very unstable when set up. They have no storage compartments and are not designed to protect the user from the environment.

The manner in which main support ropes on conventional hammocks attach to upright supports, such as trees, has a propensity to tip or roll thereby dumping the user on the ground. For this reason, hammocks have not found great favor among campers or those using a hammock in wilderness situations. Several attempts have been made to alleviate this inadequacy of hammocks, but have not been successful. An example is U.S. Pat. No. 2,375,792. The '792 patent uses a multiple rope method of securing the hammock to the upright support to prevent tipping or rolling. The hammock must also have solid bars to provide shape to the hammock. All of these features are undesirable from a weight and function standpoint.

SUMMARY OF THE INVENTION

This invention provides an easy to carry and convenient tent-like hammock which is suspended above ground. The manner in which the main support ropes attach make it safer to use because it won't tip or roll thereby dumping its occupant. It feels more secure because the sides of the tent hammock come up around the occupant. A rain tarp is sewn down at the foot end to provide a controllable compartment helping one to keep the tarp secure even in the laying position. Heavy elastic bands attached to both ends of the rain tarp which keeps stress under control regardless of the weight carried in the tent hammock. The netting is dropped below the rain tarp about 3 inches to provide space between the fly and netting so that condensation can run off without soaking the occupant. The strap which provides this space also compensates for the uneven pull between the rain tarp and bed of the tent hammock. Large pockets attached under the tent hammock keep all gear stored off the ground and within easy reach of the occupant. They also provide insulation from cold which can enter from the bottom of the hammock. It rolls up to a very small size, just 6"×14", and is very lightweight because it needs no poles, stays, metal springs or rings to keep it stable. Zippers are provided on both sides making it possible to enter or exit either side. This is important because of the variable conditions encountered when pitching the tent hammock in wilderness areas.

The rain tarp can be spread out on one side or both sides providing good visibility but still protecting from rain or sun. The tarp can be pulled completely over to one side exposing to view the sky, as also can the netting. Otherwise, the tarp can be pulled down completely on both sides and secured to protect from cold winds.

The tent hammock is light-weight because it has no poles or stakes and is made from lightweight woven fabrics. Trees are intended as the only support required. A tarp and netting are supported from the trees by common ropes; and the main ropes which support the weight of the tent hammock are independent of the tarp and netting.

The netting is made of a strong but lightweight fabric, such as nylon or DACRON®. The tarp is also made of a strong but lightweight woven fabric, such as ripstop nylon, and is water sealed. The lower base of the tent hammock, the part on which the occupant rests, is made of a heavier weight woven fabric such as pack cloth or cordura nylon. This base is also water sealed. The combination of the hammock, netting and tarp suspended above, form a structure similar to a tent suspended above ground. The head and foot sides are enclosed with water sealed fabric and the long sides are netted with zipper closures on both sides to make it possible to get in and out of the hammock. The tarp is sewn to the top of the netting and also sewn down both side of the netting at the foot to create a permanent seal from wind and rain. The head side of the tarp is open. The tarp can hang down on either side of the netting to protect from wind and rain or can be tied up with separate ropes to a branch of a tree for visibility.

Large pockets are sewn to the bottom side of the tent hammock with elastic or other suitable closures and are large enough to hold all gear and clothing including boots. These pockets also form a near dead air space below the tent hammock base and the occupant providing insulation from cold.

The main support ropes are attached to the hammock fabric through a sleeve formed at each end large enough in diameter to easily slide along the surface of the attached ropes. When weight is applied to the hammock, the sleeve cinches up providing an extremely strong connection between the rope and fabric. If weight is applied to the edge of the hammock the sleeve slips around the rope to form a direct line between the two support ropes and applied weight. This eliminates the formation of an unwanted pivot point. The hammock, therefore, becomes extremely stable, allowing one to sit on the very edge without any fear of tipping the hammock. This design also eliminates the complicated rope support structures common in other hammock designs where many ropes all come together at a single pivot point. This feature makes prior art hammocks unstable and prone to flipping over. In this design, there is only one rope for each end, which is attached directly to the hammock fabric itself through a sleeve, and because the sleeve can slip on the rope, there is no pivot point.

THE DRAWINGS

A preferred embodiment of the invention is illustrated in the accompanying drawings in which:

FIG. 1 is a perspective view of the tent hammock of the invention showing the tent hammock supported for use between two trees;

FIG. 2, a detailed perspective view of the hammock shown in FIG. 1;

FIG. 3, a foot-end view of the hammock shown in FIG. 2;

FIG. 4, a head-end view of the hammock shown in FIG. 2;

FIG. 5, a detailed view of the main rope attachment to the hammock shown in FIG. 2; and FIG. 6, a sectional view of the point of attachment of the main rope to the hammock along lines 6—6 of FIG. 5.

DETAILED DESCRIPTION OF THE PREFERRED EMBODIMENTS

Figure 1:
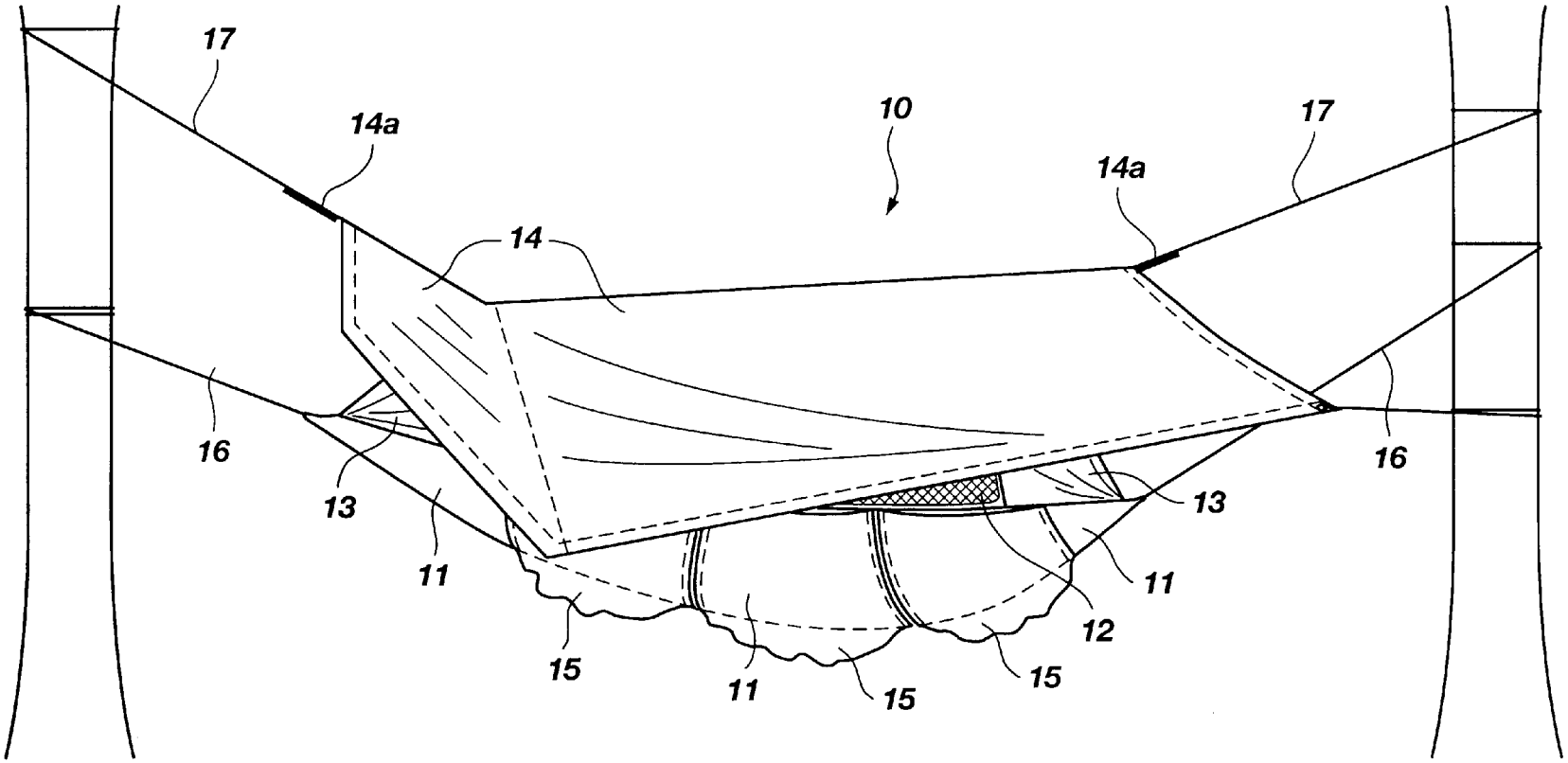
Figure 2:
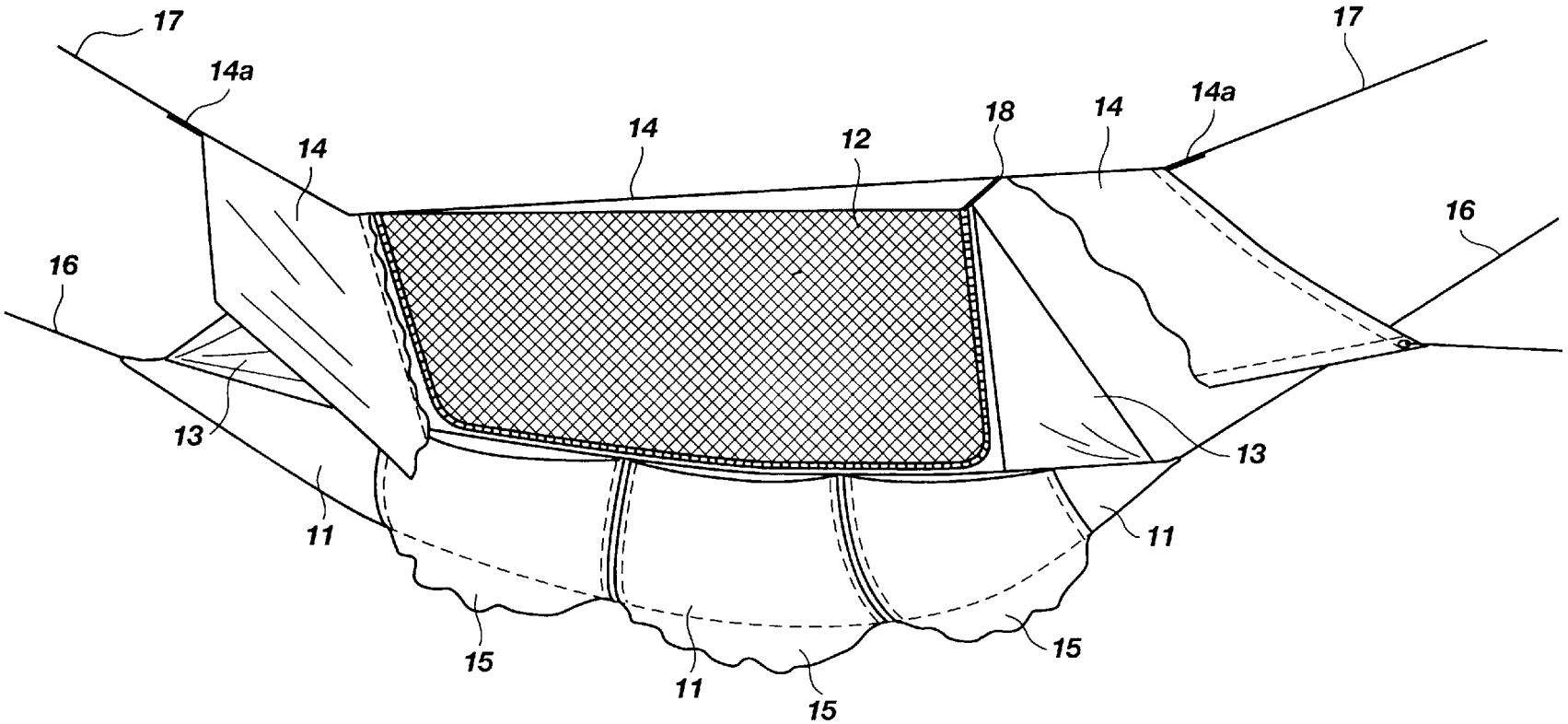

As shown in FIGS. 1 and 2, an overview of the tent hammock 10 of the invention includes a hammock base 11, netting 12, head and foot end sections 13, rain-fly 14 and storage pockets 15. The preferably large pockets 15 placed underneath the hammock base 11 provide room for all gear, food and supplies to be stored above ground. These pockets 15 not only keep gear off the ground where water or insects can get to it, but they also keep gear close by and within easy reach of the occupant in the hammock. Another important function provided by the pockets 15, is a nearly dead air space to the underside of the hammock base 11 (see FIGS. 3 & 4) which helps to insulate the underside of the hammock base.

The large rain-fly 14 which covers the hammock base 11 is tapered and sewn down at the foot end of the hammock base 11, protecting the occupant against water or wind penetrating the foot end. The head end of the hammock 10 is within easy reach; and fly 14 can be pulled down around the hammock 10 in bad weather or left up for warm, clear nights. (See FIGS. 2, 3 & 4). All fabrics are preferably water sealed.

Figure 5:
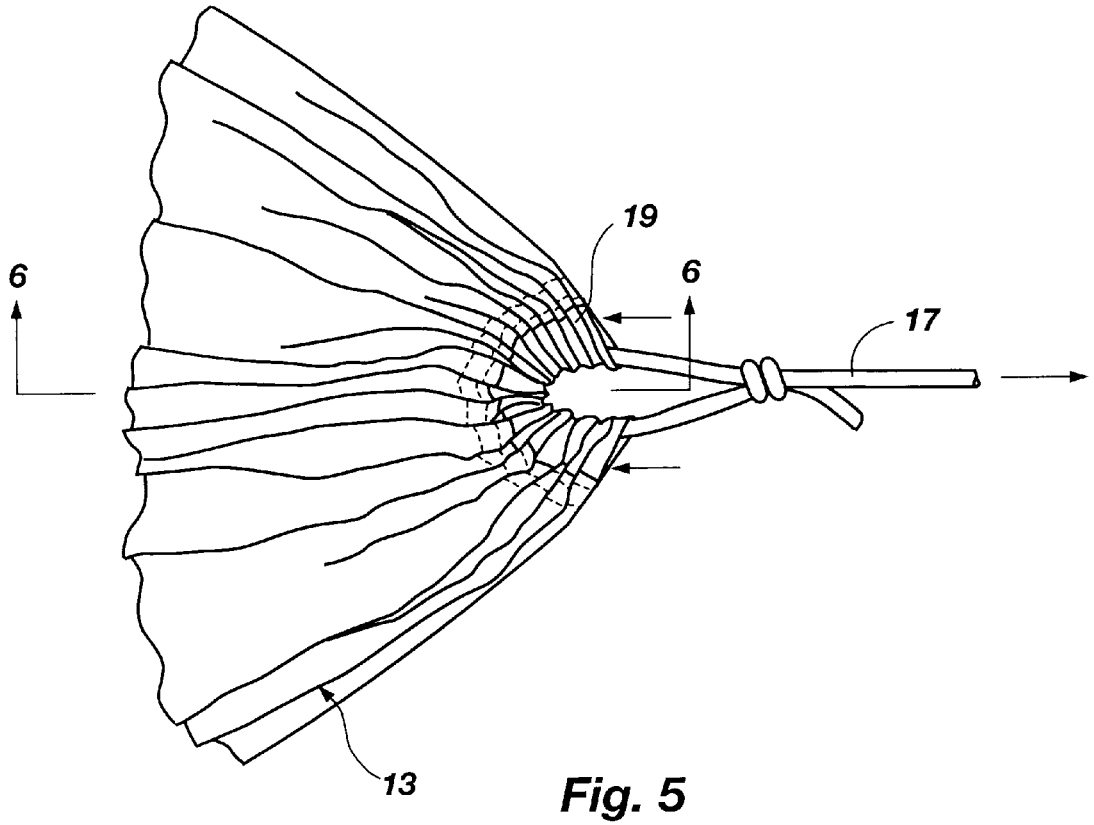
Figure 6:
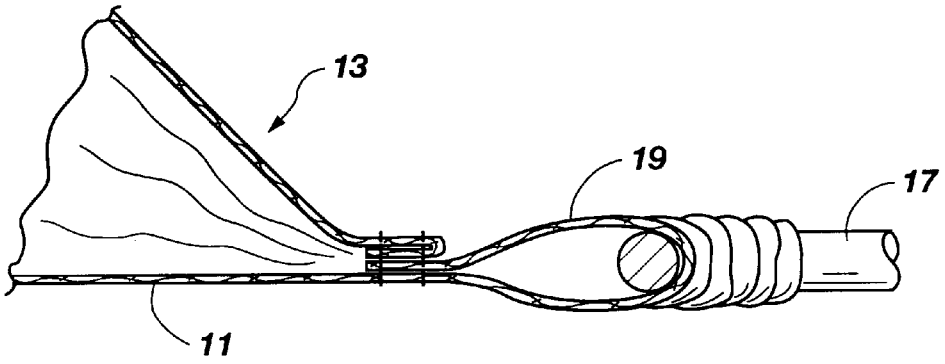

As shown in FIGS. 5 and 6, the ropes 16 which support the weight of the hammock 10 are attached to the hammock in a unique manner which prevent it from tipping over or rolling. This feature eliminates the need for metal rings and the many support ropes which are characteristic of other hammock designs. This not only makes the hammock safe and secure, but also of lighter weight.

Elastic straps 14a attached to the ends of the rain-fly 14 adjust for stress regardless of the amount of weight in the hammock. There are no bars or stays needed to help keep its shape as in other designs.

The hammock-tent 10 when made of 1.9 oz. ripstop nylon and 6 oz. denim nylon can be rolled into a package of less than 6 inches by 15 inches. No poles, stakes, bars or stays of any kind are needed. Two trees or other solid uprights are all that is needed for its support. The netting 12 and rain-fly 14 are attached to the same trees by rope 17, but are independent of the hammock base 11, and do not contribute in any way to the stability or weight bearing functions of the hammock.

FIG. 2 shows the netting 12, water sealed end sections 13, and the storage pockets 15. The hammock-tent 10 is netted on both the right and left lateral sides, and is zippered on both lateral sides for ease of entry. The zippers can curve up at the head and foot ends to give maximum opening of the netting 12, if desired. The ability to enter the hammock from either side is advantageous depending on where the hammock is set up in wilderness locations. A strap 18 sewn at the peak of the netting 12 and attached to the rain-fly 14, provides a space between the fly 14 and netting 12, so that condensation which can collect under the rain-fly 14, and can run off the rain-fly 14 to the ground without soaking the occupant or netting 12. This strap 18 is also flexible providing a compensating feature. If the rain-fly 14 is pulled too far to one side, for example, the strap 18 will adjust to it, keeping the netting properly deployed above the hammock base 11.

The sealed end sections 13 are sewn to the zippers and provide protection at the head and foot from weather.

Figure 3:
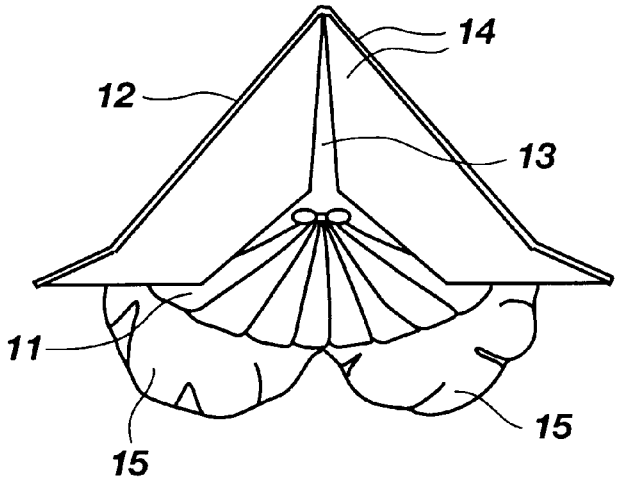
Figure 4:
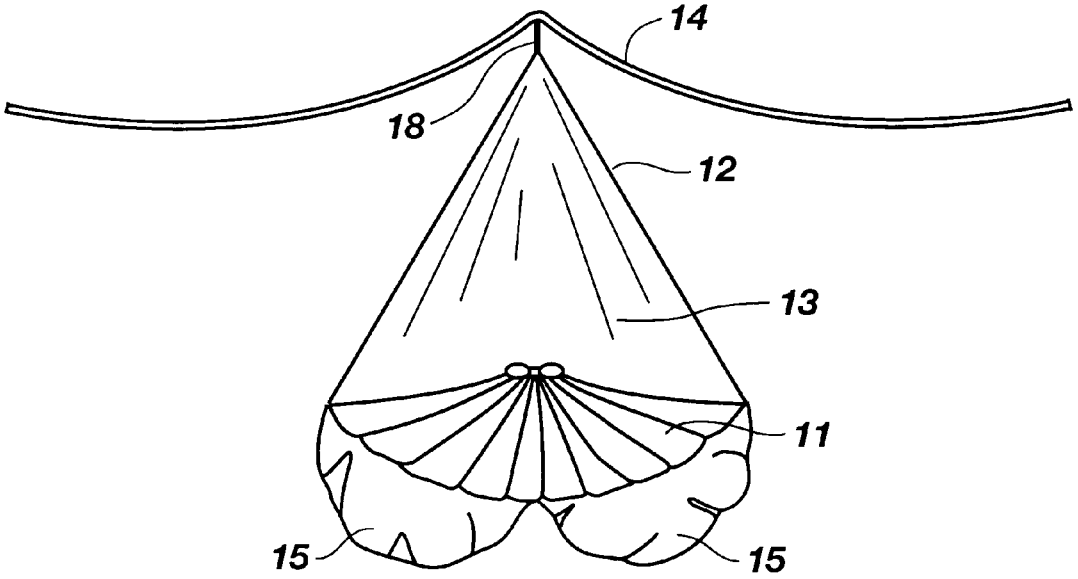

FIGS. 3 and 4 show a view of the tent hammock 10 from both the foot and head ends. The storage pockets 15 cover the bottom of tent hammock base 11 from left to right. Elastic or other closures pull the storage pockets 15 closed helping to provide a near dead-air space between the hammock floor and provide for billowing of the pocket fabric. The insulation effect is enhanced when items such as clothing and other equipment are placed in the pockets, which also helps to retain the billowing shape of the pockets 15.

The storage pockets 15 are large enough to hold almost anything a camper or back packer can carry. The pockets 15 keep equipment, food and personal items off the damp ground, protected from insects and within easy reach of the occupant of the hammock.

FIGS. 5 and 6 illustrate the manner in which the main ropes 17 connect to the hammock base 11. This is an important improvement over other hammocks, because it eliminates the need for the multiple rope and metal ring structures found in other hammocks, and enables the present tent hammock to have such a lightweight design. It also provides great stability to the hammock, since the hammock will not tip or roll over like other hammocks. It is even possible to sit on the very edge with no fear of tipping.

The inventive connection is formed by folding the end of the hammock fabric over to form a sleeve like structure 19. The sleeve 19 is constructed large enough to loosely fit around the rope 17 which is threaded through the sleeve thus making it possible for the fabric to easily slide along the rope 17. If weight is applied to the edge of the hammock for example, the sleeve 19 slips or moves along the rope to a position providing a direct line between the weight in the hammock and the support ropes, thus eliminating any pivot points. This creates the great stability alluded to above. Also, as an added feature of this design, as weight is applied to the hammock, the sleeve 19 cinches up tight, thereby providing an extremely strong connection to the rope 17.

This design makes it possible for one to sit on the edge of the hammock, take off footgear and place them in the pockets, then turn and slide into the hammock without ever touching the ground.

FIG. 6 is a side view taken along Line 6—6 of FIG. 5, showing how the rope 17 goes through the loosely fitted sleeve 19. Sleeve 19 is thereby facilitated to slide along the rope 17 eliminating any pivot points and giving the design great stability.

While this invention has been described and illustrated herein with respect to preferred embodiments, it is understood that alternative embodiments and substantial equivalents are included within the scope of the invention as defined by the appended claims.

I claim:

1. A hammock for disposition above ground between two uprights, comprising in combination:

an elongate hammock base constructed of flexible fabric and having a head section at one longitudinal end thereof and an opposing foot section at the opposite longitudinal end thereof; said hammock base having a pair of opposing side sections extending from one longitudinal end of the hammock base to the other;

each of said end sections having base fabric folded back upon itself to form a flexible hollow fabric sleeve at each of said end sections;

a pair of flexible ropes each of which extend respectively through the flexible hollow fabric sleeves for securing each base section in a stable, non-rotating relationship to the rope, with one end of the rope extending outwardly from the respective end sections for attachment to respective uprights;

a rain-fly sheet of fabric secured at said foot section of the hammock base and supported by a separate rope extending between two uprights a distance above said hammock base; and a netting sheet supported by said rain-fly sheet approximately two inches below said sheet and permanently attached at the end to said foot section of the hammock base, and being removably attached to said hammock base along three sides of the netting sheet.

2. A hammock set forth in claim 1, including a plurality of pockets disposed along the underside of said hammock base for storage and insulation.

* * * * *